343-700 MS AU 254 EX
6/15/82 XR 4,335,289

United States Patent [19]
Smith

[11] 4,335,289
[45] Jun. 15, 1982

[54] MICROWAVE OVEN

[75] Inventor: Duaine W. Smith, Tiffin, Iowa

[73] Assignee: Amana Refrigeration, Inc., Amana, Iowa

[21] Appl. No.: 971,717

[22] Filed: Dec. 21, 1978

[51] Int. Cl.[3] ..... H05B 6/72
[52] U.S. Cl. ..... 219/10.55 F; 333/238; 343/700 MS
[58] Field of Search ..... 219/10.55 F, 10.55 R, 219/10.55 M; 333/238, 246; 343/700 MS, 846, 848, 849

[56] References Cited

U.S. PATENT DOCUMENTS

| | | | |
|---|---|---|---|
| 2,961,520 | 11/1960 | Long | 219/10.55 F |
| 3,436,507 | 4/1969 | Puschner | 219/10.55 R |
| 3,471,671 | 10/1969 | Puschner | 219/10.55 F |
| 3,562,471 | 2/1971 | White | 219/10.55 F |
| 3,619,536 | 11/1971 | Boehm | 210/10.55 B |
| 3,805,009 | 4/1974 | Sweet | 219/10.55 A |
| 3,947,850 | 3/1976 | Kalol | 343/846 X |
| 4,028,519 | 6/1977 | DeWeese et al. | 219/10.55 B |
| 4,028,520 | 6/1977 | Torrey | 219/10.55 B |
| 4,028,521 | 6/1977 | Uyeda et al. | 219/10.55 F |
| 4,049,938 | 9/1977 | Ueno | 219/10.55 F |
| 4,071,846 | 1/1978 | Oltman, Jr. | 343/700 MS |
| 4,092,513 | 5/1978 | Rasmussen | 219/10.55 F |
| 4,107,501 | 8/1978 | Ironfield | 219/10.55 F |
| 4,144,436 | 3/1979 | Hauck | 219/10.55 F |
| 4,144,437 | 3/1979 | Ehlers | 219/10.55 F |
| 4,176,266 | 11/1979 | Kaneko et al. | 219/10.55 F |
| 4,185,181 | 1/1980 | Kaneko et al. | 219/10.55 F |

FOREIGN PATENT DOCUMENTS

| | | | |
|---|---|---|---|
| 2312165 | 12/1976 | France | 219/10.55 |

*Primary Examiner*—Arthur T. Grimley
*Attorney, Agent, or Firm*—Robert W. Hoke, II; Hugh D. Jaeger

[57] ABSTRACT

A microwave oven cavity of a microwave oven having an antenna assembly axially supported on one wall of the cavity. The antenna assembly includes an antenna rotating assembly having a bushing mounted in the wall, a bearing axially supported in the bushing, a probe antenna supported in a bearing and extending into the cavity, a directional rotating antenna attached to the probe antenna, and an antenna rotor having a plurality of turbine vanes affixed to the directional rotating antenna which axially drive the directional rotating antenna when forced by air flow velocity circulated through the cavity. The antenna rotating assembly, the directional antenna, and the antenna rotor are integrated for installation and removal from within the confines of the cavity. The antenna assembly engages and locks in position in the wall of the cavity. A grease shield provides for predetermined defined directional air flow velocity of air circulated through the cavity, provides for rotation of the antenna rotor assembly supported on the directional rotating antenna of the antenna assembly for uniform energy distribution and consistent heating within the cavity, provides for passing air through the cavity and past the door of the cavity to keep the cavity free of vapors and the door free of moisture, and provides for exhausting of the vapor and moisture out through the top wall of the cavity and through an exhaust vent in the front of the microwave oven.

24 Claims, 16 Drawing Figures

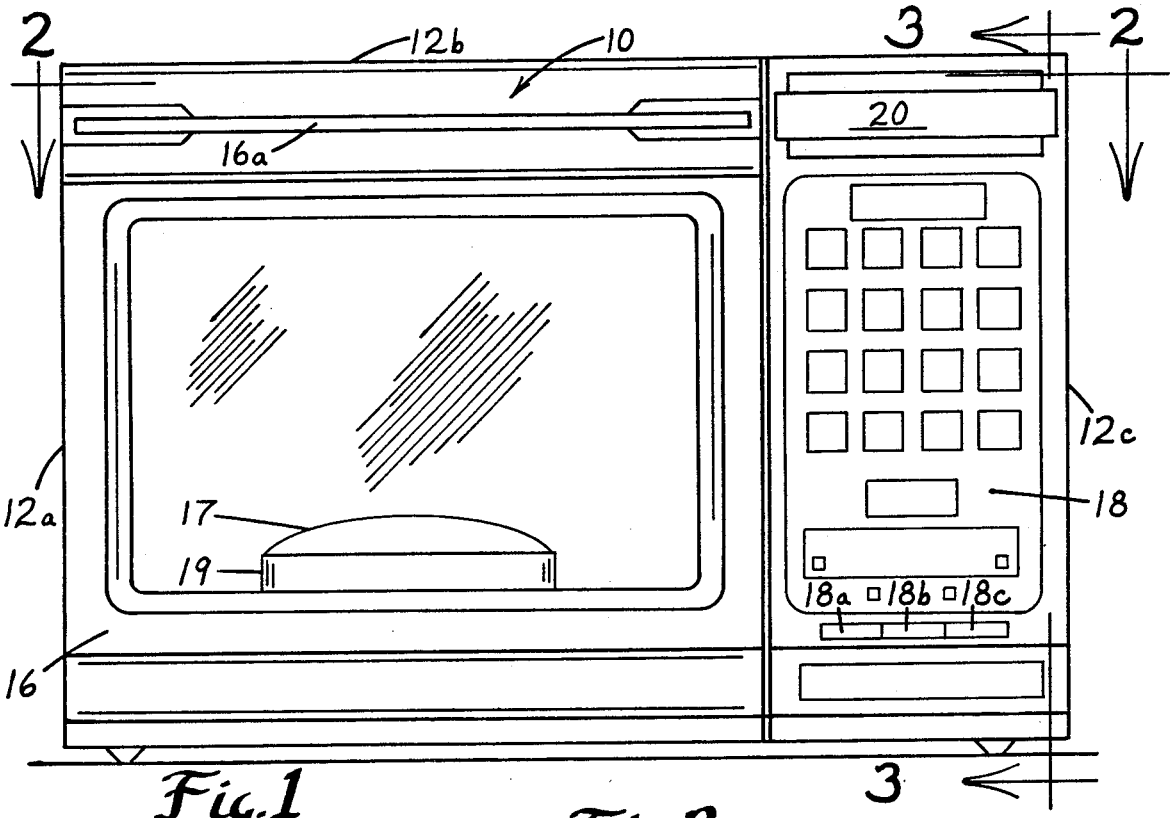
Fig. 1
Fig. 3
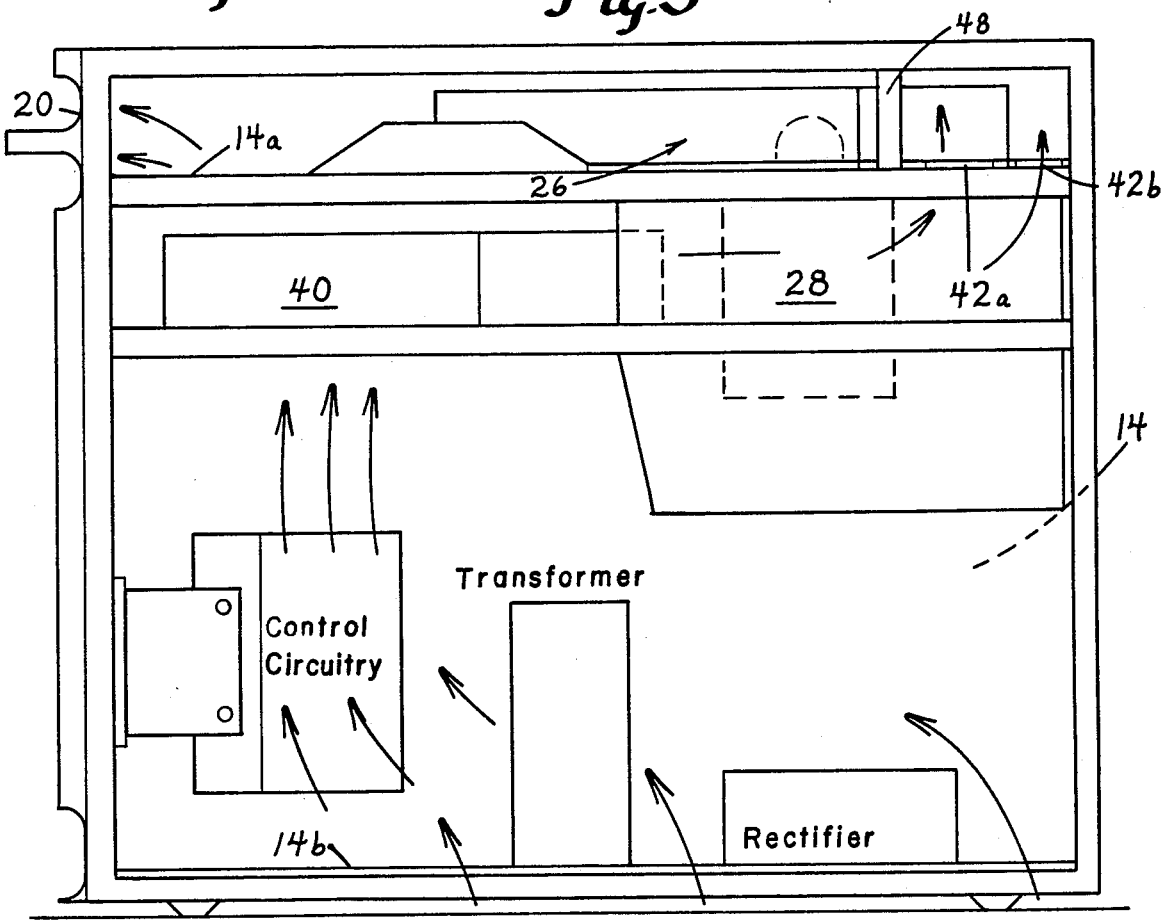

46
46a
46b
46c
46d
46e
46g
46k.1
46k.2
46k.3
46k.4
51a
51b
51c
51d
15
15

46
46c
46d
14a
46g
46j
14a.2
52
46i
46h

MICROWAVE OVEN

CROSS REFERENCES TO COPENDING APPLICATIONS

The present invention relates to a patent application MICROWAVE OVEN, Ser. No. 971,727, filed Oct. 21, 1978, by James E. Simpson, which is assigned to the assignee of the present invention and to a patent application MICROWAVE OVEN HAVING ROTATING CONDUCTIVE RADIATORS, Ser. No. 965,636, filed Dec. 1, 1978, by John M. Osepchuk, which is assigned to the parent company of the assignee of the present invention.

BACKGROUND OF THE INVENTION

1. Field of the Invention

The present invention relates generally to heating with electromagnetic wave energy in a conductive cavity, and more particularly, pertains to an antenna assembly including a directional rotating antenna, an antenna rotor, an antenna rotating assembly, and a grease shield for directing air flow velocity to drive the antenna rotor to axially rotate the directional antenna axially supported by the antenna rotating assembly.

2. Description of the Prior Art

Prior art microwave ovens suffer from nonuniform energy distribution, and more particularly, nonuniform heating patterns depending upon the type of particular product, which usually is food, being heated. The nonuniform heating pattern occurs because of the unequal distribution of microwave energy coupled into a conductive cavity of a microwave oven from a source of microwave power such as a magnetron, from the reflections of microwave energy from the product within the microwave oven cavity, and the conductive sidewalls framing the microwave oven cavity. Multiple reflections within the conductive microwave oven cavity occur and produce configurations of the electromagnetic fields referred to as modes. These reflections cause constructive and destructive interference at and in different parts of the product being heated, and therefore, result in hot areas intermixed with cold areas. Where the product is food, the result is overcooked areas of the food intermixed with undercooked areas of the food.

Some food products which have been particularly difficult to cook in the prior art microwave ovens include yeast products such as breads; baked products such as cakes and pies; scattered products such as cookies, appetizers, and hors d'euvres, and; egg dishes such as custards and quiches. All of these types of food products when cooked in the prior art microwave ovens have exhibited overcooked areas intermixed with undercooked areas leaving much to be desired in the cuisine of the consuming gourmet.

The prior art processes for improving the nonuniform energy distribution patterns in the prior art microwave ovens have been mode stirring which attempts to randomize reflections by introducing a time varying scattering of the microwave energy; utilizing a turntable within the microwave oven cavity to rotate the product about a vertical axis within the microwave oven separately or in combination with a mode stirrer; and, utilizing rotatable antennas within the microwave oven cavity.

The prior art process of utilizing rotatable antennas or exciters within the microwave oven cavity has been deficient from the point that rotatable antennas or exciters within the microwave oven cavity failed to achieve a uniform energy distribution and complex mechanical structure has been required to support and rotate the antennas.

In rotating physical structures within the microwave oven cavity, a rotating mechanism such as an electric motor was required along with suitable mounting of the motor, isolating the motor and shaft from the electromagnetic field within the microwave oven cavity, and providing additional energy to power and drive the electric motor. Further, the prior art rotation assemblies of either turntables or antennas were always subject to mechanical breakdown and in the event of mechanical breakdown, a skilled serviceman was required to service the mechanical working components of the microwave oven.

The present invention provides a microwave oven having a uniform energy distribution pattern and overcomes the disadvantages of the prior art microwave ovens.

SUMMARY OF THE INVENTION

The purpose of the present invention is to provide a microwave oven with an antenna assembly including a directional rotating antenna which axially rotates about an axis of the microwave oven cavity and an antenna rotating assembly which locks and unlocks in engagement in the wall of the cavity. The directional rotating antenna supports an antenna rotor including a plurality of turbine vanes, which when struck by air flow velocity circulated through the cavity, rotates about the center axis of the directional rotating antenna. Another purpose of the present invention is to provide a grease shield to direct the air flow velocity of air past the turbine vanes, past the front of the microwave oven door to clear the door of moistures and vapors, exhaust the air through the top wall of the microwave oven cavity, and out through a vent in the front of the microwave oven.

According to one embodiment of the present invention, there is provided an antenna assembly for a microwave oven including an antenna rotating assembly supported on an axis of a horizontal wall of a microwave oven cavity and having at least one axially rotatable bearing; plurality of fingers extending outwardly from the antenna rotating assembly which provide for engagement and disengagement of the antenna assembly on the wall from within the confines of the cavity; a directional rotating antenna in the cavity having a probe antenna extending between the cavity and waveguide and supported by the axially rotatable bearing; and, an antenna rotor having a plurality of turbine vanes extending radially outward whereby the probe antenna couples energy from a microwave power source to the directional rotating antenna and the velocity of the air flow circulated through the microwave oven cavity strikes the vanes of the antenna rotor to axially rotate the directional rotating antenna about the axis of the axially rotatable bearing thereby providing uniform energy distribution and consistent heating in the microwave oven cavity.

According to another embodiment of the present invention, there is provided a grease shield for shielding the top wall of a microwave oven cavity from splatter including a plurality of upwardly extending vertical members in the rear of the grease shield to direct incoming air flow from holes in the rear of the cavity to the front of the cavity above the grease shield and driving directional rotating antenna having an antenna rotor including turbine vanes; a plurality of perforations in a forward portion of the grease shield to exhaust air from between the top wall of the cavity and the grease shield into the cavity; and, a plurality of longitudinal perforations adjacent to the door to exhaust air out of the cavity whereby the grease shield is removable for cleaning and for access to the antenna assembly in the top wall of the cavity.

One significant aspect and feature of the present invention is an antenna assembly having an antenna rotating assembly including the directional rotating antenna which supports and engages with the antenna rotor. The antenna assembly can be installed and removed from within the immediate confines of the microwave oven cavity with a U-shaped tool. If the need arises to replace the antenna rotating assembly which is extremely unlikely but in such an unlikely event, it is necessary to remove the screws of the grease shield and subsequently remove the antenna assembly with a U-shaped tool which extends up through two holes in the directional rotating antenna and into a bushing of the antenna rotating assembly. With a counterclockwise twist, the antenna assembly unlocks from the top wall of the microwave oven and is removed from within the interior confines of the microwave oven cavity.

Another significant aspect and feature of the present invention is to provide a grease shield which can be removed from the microwave oven for cleaning by the user by removing screws from the microwave oven thereby permitting the user to keep the microwave oven in cleanliness condition.

Having briefly described one embodiment of the present invention, it is a principal object hereof to provide a microwave oven having a removable antenna assembly and a removable grease shield, both attributing to uniform energy distribution and consistent heating within the microwave oven.

An object of the present invention is to provide uniform energy distribution of microwave energy and a consistent uniform heating pattern in a product being heated in the cavity, especially food, by an antenna assembly axially rotated about an axis of one wall of the microwave oven cavity. The present invention provides uniform heating of foods, especially sensitive foods, over short periods of time. The present invention provides for the microwave cooking of sensitive foods such as yeast breads, cakes, quiches, and scattered loads such as cookies. The microwave cooking of foods according to the present invention is faster for small and compact loads, and require virtually no manual manipulations of the food during microwave cooking even though cooking manipulations may be required depending upon the type of food being cooked.

Another object of the present invention is to provide an antenna assembly for uniform microwave energy distribution and consistent heating in a product being heated within a microwave oven cavity of a microwave oven. The antenna assembly includes a directional rotating antenna axially supported in the antenna rotating assembly, and an antenna rotor supported and engaged to the directional rotating antenna. A probe antenna affixes to a common junction of the directional rotating antenna. The antenna rotating assembly has at least one axial component supporting the probe antenna. The antenna rotating assembly includes a plurality of outwardly extending fingers to lock the antenna assembly into position in the top wall of the microwave oven cavity. The antenna is a two-by-two array of four end driven half-wavelength resonating elements which are connected to the axially supported probe near the center of the microwave oven cavity by support elements and microstrip parallel plate transmission feed line conductors. The antenna rotor includes a dielectric disc having a plurality of outwardly radially extending circumferentially spaced vanes to receive air flow velocity in a turbine manner and a plurality of downward extending U-shaped channel members having slots from the dielectric disc to encompass the support members between the resonating elements and the parallel plate transmission line conductors.

A further object of the present invention is to provide a microwave oven having a removable grease shield for cleaning of the grease shield and for installation of the antenna assembly. The grease shield is affixed to the top wall of the microwave oven cavity with a plurality of screws and is removable for cleaning in the event as required.

An additional object of the present invention is to provide an antenna assembly which is easily manufactured and assembled, and does not require complex mechanical machinery for manufacture or assembly. The antenna rotating assembly includes molded plastic components. The directional rotating antenna is stamped and subsequently formed by two complimentary actions of wiping dies. The antenna rotor is a molded plastic component. A still further object of the present invention is to provide a grease shield in the microwave oven cavity of the microwave oven cavity which directs air flow velocity to vent the microwave oven cavity of moisture and cooking vapors, and more importantly, directs the air flow velocity to rotate the antenna assembly including the directional rotating antenna in a clockwise direction about a vertical axis of the microwave oven cavity. The air flow velocity is forced through the microwave oven and the microwave oven cavity including the space between the top wall of the microwave oven cavity and the grease shield in a direct path of least resistance providing for cooling of not only the internal power supply components of the microwave oven but also venting of the microwave oven cavity of vapors and moisture.

A still additional object of the present invention is to provide a microwave oven cavity having uniform energy distribution and providing uniform heating of a product in a microwave oven cavity, especially food products. Particularly, the microwave oven of the present invention provides for consistent even heating in foods such as baked goods and yeast products over short periods of time. Specifically, the microwave oven of the present invention has overcome the shortcomings of the prior art by providing a microwave oven which consistently and evenly cooks baked goods, yeast breads, quiches, in addition to cooking of scattered products such as cupcakes, appetizers, hors d'oeuvres, hot dogs, sausage, hamburgers, bacon, etc., and the ordinary foods usually cooked in the microwave ovens. The microwave oven also cooks such foods as cookies, egg dishes such as egg custards, and yeast breads. The microwave oven further cooks roasts, meatloafs, chickens, turkeys, and other large body meats. Finally, the microwave oven provides uniform energy distribution and heating so that evaporation of the moisture from the food product is minimum and the foods retain moisture during cooking.

BRIEF DESCRIPTION OF THE DRAWINGS

Other objects and many of the attendant advantages of this invention will be readily appreciated as the same becomes better understood, by reference to the following detailed description when considered in connection with the accompanying drawings, in which like reference numerals designate like parts throughout the figures thereof and wherein:

FIG. 1 illustrates a front view of a microwave oven of the present invention;

FIG. 3 illustrates a section of the present invention taken on line 3—3 of FIG. 1 looking in the direction of the arrows and illustrates a side view of the microwave oven;

DESCRIPTION OF THE PREFERRED EMBODIMENTS

Figure 4:
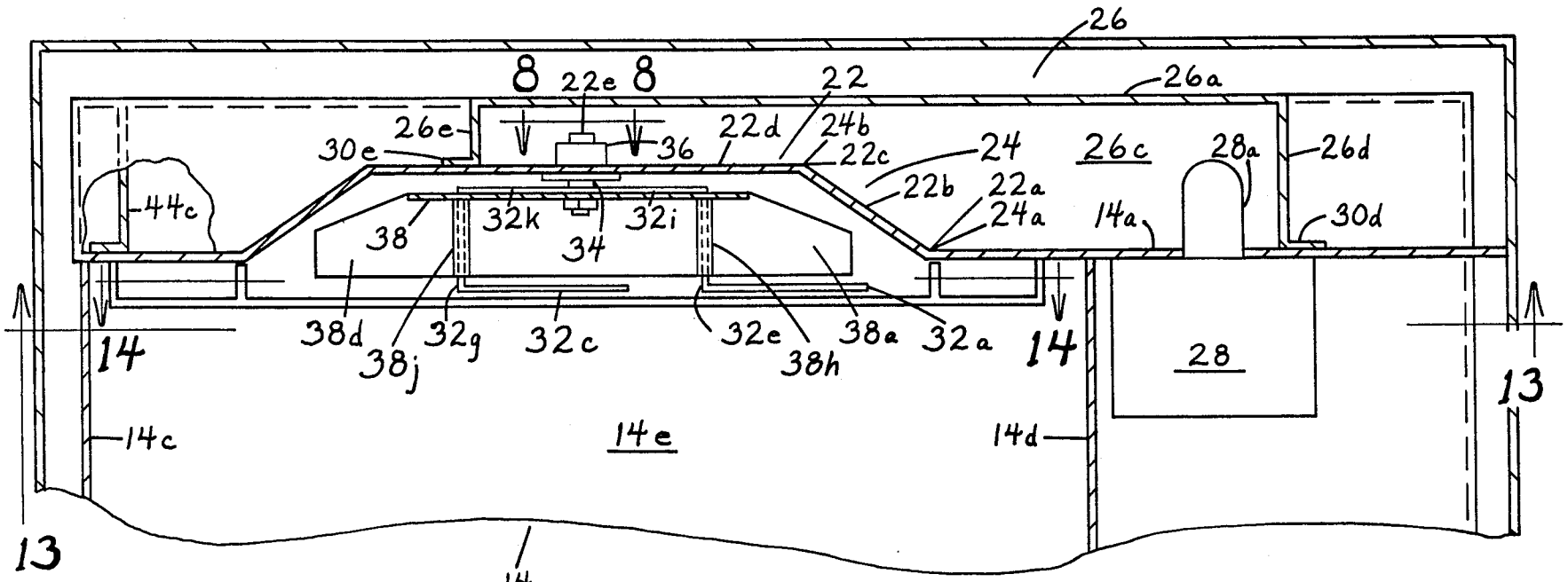
FIG. 4 illustrates a section of the present invention taken on line 4—4 of FIG. 2 looking in the direction of the arrows and illustrates an upper vertical sectional view of the microwave oven.

FIG. 1, which illustrates a front view of a microwave oven 10 of the present invention, shows the microwave oven 10 having a three-sided channel shaped housing cover **12*a*–12*c* respectively housing and enclosing the internal components of the microwave oven 10 as now described. A microwave oven cavity 14 of the microwave oven 10 as also illustrated in FIG. 4 includes five metallic conductive sides, such as stainless steel by way of example and for purposes of illustration only, and includes a top wall 14*a*, a bottom wall 14*b* not illustrated in the figures, a left sidewall 14*c* and a right sidewall 14*d* illustrated in FIG. 4, and a rear wall 14*e* which are secured to each other such as by welding to form the five-sided conductive microwave oven cavity 14. A bottom hinged door 16 pivots within the confines of the walls 14*a*–14*d* of the microwave oven cavity 14, and includes a microwave energy absorbing structure such as quarter wave choke and a carbon impregnated door gasket surrounding the outside perimeter of the door 16 to dissipate any leakage of microwave energy between the walls 14*a*–14*d* and the outer perimeter of the door 16. A see-through window, by way of example and for purposes of illustration only, affixes in the center of the door 16. A door handle 16*a* on the top of the hinged door 16 facilitates opening and closing of the door 16. A cake 17 in a glass cake pan 19 cooks in the microwave oven 10 and is observed through the door 16. An automatic safety latch lever not illustrated in the figure mounts on one side of the door 16 to lock the door 16 in a closed position when the microwave oven 10 is energized. A control panel 18 supports a plurality of programmable keyboard controls connected to microprocessor control circuitry or electromechanical control circuitry to control a microwave oven power supply connected to a microwave power source for predetermined heating time, temperature, and power levels. Start, stop, and microwave cavity light switches 18*a*, 18*b*, and 18*c* respectively are positioned at the bottom of the control panel 18. An exhaust vent 20 mounts in the upper front right corner of the microwave oven 10 directly above the control panel 18 to exhaust cavity vapors and moisture from the microwave oven cavity 14** as later described.

Figure 2:
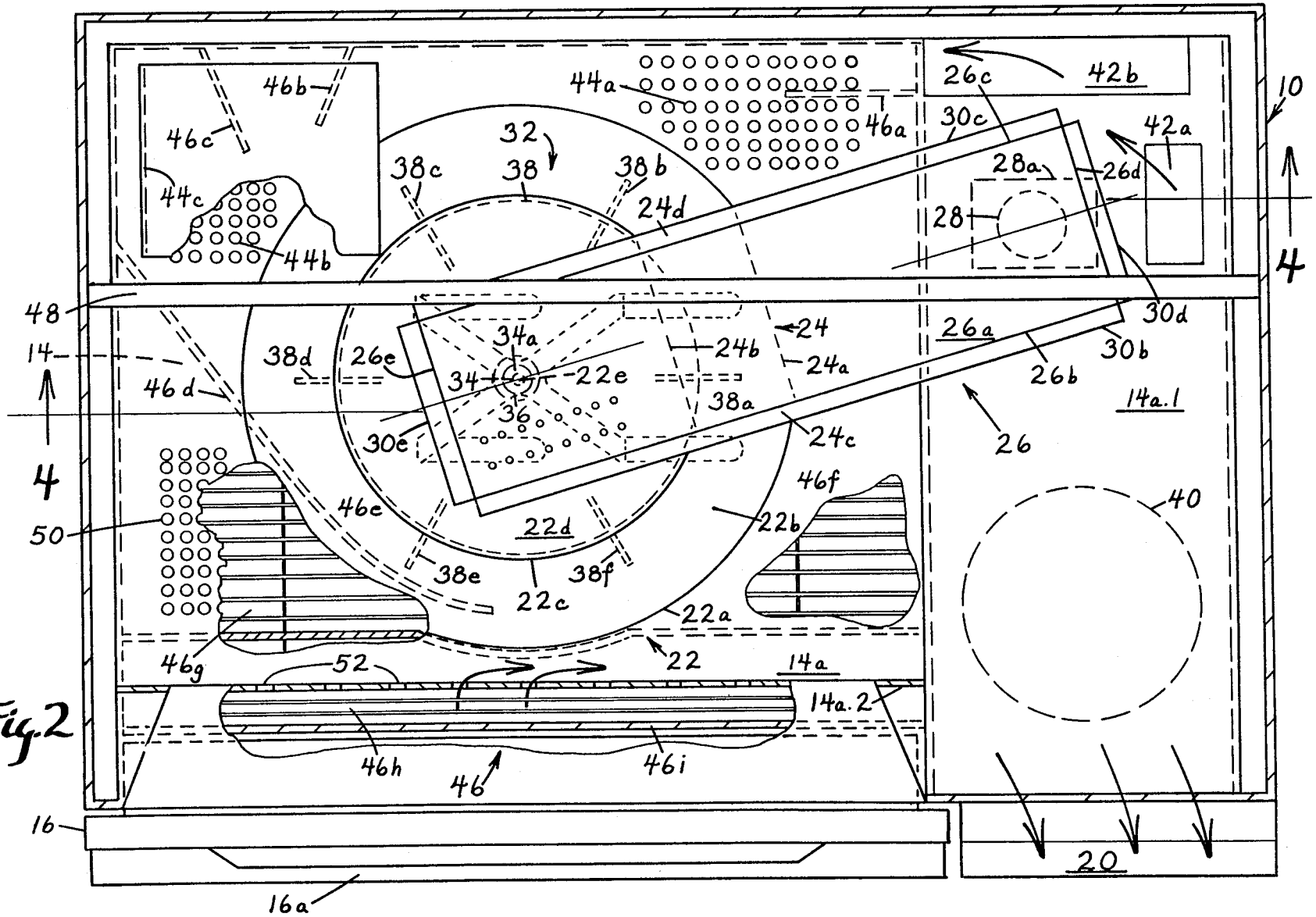
FIG. 2 illustrates a section of the present invention taken on line 2—2 of FIG. 1 looking in the direction of the arrows and illustrates a section of the present invention.

FIG. 2, which illustrates a section of the present invention taken on line 2—2 of FIG. 1 looking in the direction of the arrows and partially cutaway, shows a top view of the microwave oven 10. A flattened conical shaped dome 22 having a large diameter **22*a* positions in the top wall 14*a* of the microwave oven cavity 14. An angular sloping section 22*b* including a planar rectangular transition section 24 as later described extends above the top wall 14*a* of the microwave oven cavity 14 to a small diameter 22*c* which determines the angular degree of the slope of the dome 22. A planar flattened truncated top wall 22*d* of the dome 22 is parallel to the top wall 14*a* of the microwave oven cavity 14. The rectangular transition section 24 provided on the angular slope section 22*b* of the dome 22 includes a lower transition junction 24*a* between the top wall 14*a* of the microwave oven cavity 14 and the transition section 24, and an upper transition junction 24*b* between the transition section 24 and the flattened wall 22*d* of the dome 22. A front junction 24*c* and a back junction 24*d* extend between the junctions 24*a* and 24*b* respectively along the longitudinal length of the transition section 24. A three-sided waveguide 26 having tapers on the two opposing vertical sidewalls 26*b* and 26*c* corresponding to the tapers of the rectangular dome 22 and transition 24 as also illustrated in FIG. 3, affixes between the microwave power source 28 having an antenna 28*a* on a top wall extension 14*a*.1 of the top wall 14*a* of the microwave oven cavity 14 and to a point beyond the center 22*e* on the flat truncated wall 22*d* of the dome 22. The waveguide 26 includes a top wall 26*a*, vertically tapered sidewalls 26*b* and 26*c*, and end walls 26*d* and 26*e* where the distance between the end wall 26*e* to the center 22*e* of the dome 22 compensates the matching of the microwave power source 28 to the microwave oven cavity 14 as later described. Flanges 30*b*, 30*c*, 30*d*, and 30*e* are provided at the bottom of the waveguide sidewalls 26*b***, 26c, 26d, and 26e respectively of the waveguide 26 to affix the waveguide 26 to the top wall extension 14a.1, the top wall 14a, the tapered section 24, the slope 22c of the dome 22, and the top wall 22d of the dome 22, all of which serve as the fourth bottom wall of the three-sided waveguide 26 respectively. A directional rotating antenna 32 illustrated in dashed lines and also referring to FIGS. 4 and 12 includes four end driven half-wavelength resonating elements 23a–32d parallel to the top wall 14a and dome wall 22d, vertical supports 32e–32h connected to each of the elements 32a–32d, microstrip parallel plate transmission line conductors 32i–32l parallel to the top wall 14a of the microwave oven cavity 14 and dome wall 22d which connect to each of the vertical supports 32e–32h, and join at a junction 32m. A probe antenna 34 having a capacitive hat 34a axially mounts in a dielectric antenna rotating assembly 36 located at the center 22e of the flattened wall 22d of the dome 22 as later described in detail in FIGS. 5–9 and connects to the junction 32m of the directional rotating antenna 32. The probe antenna 34 extends between the microwave oven cavity 14 and partially into the waveguide 26 above the top wall 22d of the dome 22. A dielectric circumferential disc 38 surrounds the parallel plate transmission line conductors 32i–32l and affixes thereto. A plurality of turbine vanes 38a–38f are circumferentially positioned around the circular disc 38 and are driven by forced air flow velocity circulated through the microwave oven cavity 14 as later described in detail. A blower 40, such as a squirrel cage blower by way of example and for purposes of illustration only, draws air up through a plurality of holes not illustrated in the bottom of the microwave oven 10, between the bottom of the microwave oven 10 and the bottom wall 14b of the microwave oven cavity 14, past the control panel 18 and the microwave oven power supply components as later described, through the blower 40, past the heat dissipating plates of the microwave power source 28, and up through side and rear perforations 42a and 42b respectively in the rear right corner of the top wall extension 14a.1 of the top wall 14a. Rear and rear side perforations 44a and 44b respectively having a plurality of holes provide for air flow into a horizontal space between the top wall 14a and a grease shield 46, also referred to as a splatter shield, illustrated in FIG. 4. A longitudinal vertical upright extending member 48 longitudinally extending the length of the microwave oven housing 12b directs the air flow from the right rear, through the holes 42a and 42b, above the extension wall 14a of the top wall 14a, past the waveguide 26, past the dome 22, and into the rear and side vent holes 44a and 44b. A right angular member 44c directs the air flow through the rear side holes and also serves as a light reflector for a light bulb not illustrated for purposes of clarity. Vertical directional vanes 46a–46c and 46d as illustrated in dashed lines extend vertically upwardly on the grease shield 46 to force the air flow velocity to drive the turbine vane blades 38a–38f in a counterclockwise direction thereby rotating the directional rotating antenna 32 about the center 22e of the dome 22. Air is exhausted out of the space between the grease shield 46 and the top wall 14a at louvers 46e, 46f, and 46g of the grease shield 46 into the microwave oven cavity 14. A plurality of vent holes 50 in the left front corner of the top wall 14a of the microwave oven cavity 14 provide for exhausting of additional air out through the holes 50 in the microwave oven cavity 14. An upwardly vertical extending perforated cavity exhaust panel 14a.2 of the top wall 14a is provided with a plurality of holes 52 which provides for exhausting of vapor and moisture through the longitudinal louvers 46h in the grease shield 46 including a complimentary vertically upwardly extending member 46i. Consequently, the air flow velocity exhausts vapors and moisture out through the front exhaust vent 20.

FIG. 3, which illustrates a section of the present invention taken on line 3—3 of FIG. 1 looking in the direction of the arrows, shows a side view of the microwave oven 10. Air is drawn in through a plurality of holes in the bottom of the microwave oven 10 not illustrated for purposes of clarity in the illustration, between the bottom of the microwave oven 10 and the bottom of the microwave oven cavity 14b; around past the rectifier assembly, the transformer, and the control circuitry; up through the blower 40; through the heat dissipating plates of the microwave power source 28; up through the side and rear perforations 42a and 42b; and, down the longitudinal area between the vertical member 48 and the back wall of the microwave oven housing. The air is then forced into the cavity 14, through the cavity 14, out of the cavity 14, and out through the front exhaust vent 20 as later described.

Figure 12:
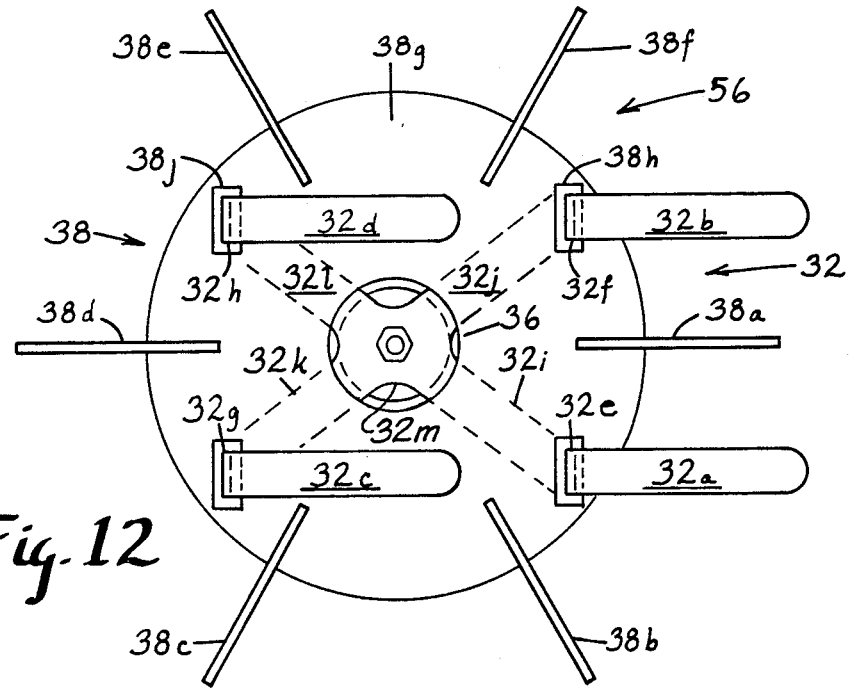
FIG. 12 illustrates a bottom view of the antenna assembly.

FIG. 4, which illustrates a section of the present invention taken on line 4—4 of FIG. 2 looking in the direction of the arrows, shows a side view of the top wall 14a of the microwave oven cavity 14, the dome 22, the large diameter 22a, the angular slope 22b, the small diameter 22c, the flattened top wall 22d, the center of the dome 22e, the rectangular transition 24, the lower junction 24a, the upper junction 24b, the waveguide 26, the top waveguide wall 26a, the waveguide sidewall 26c, the waveguide end walls 26d and 26e respectively, the microwave power source 28 including the antenna 28a, the flanges 30d and 30e, the directional rotating antenna 32, the end driven half-wavelength resonating elements 32a and 32c, the vertical connecting members 32e and 32g, the parallel plate microstrip transmission line conductors 32i and 32k, the probe antenna 34, the antenna rotating assembly 36 as described below in detail in FIGS. 5–9, the antenna support 38 including the turbine vanes 38a, 38b, 38c, 38d, 38e and 38f shown in FIG. 12, and the grease shield 46 of the microwave oven 10.

Figure 5:
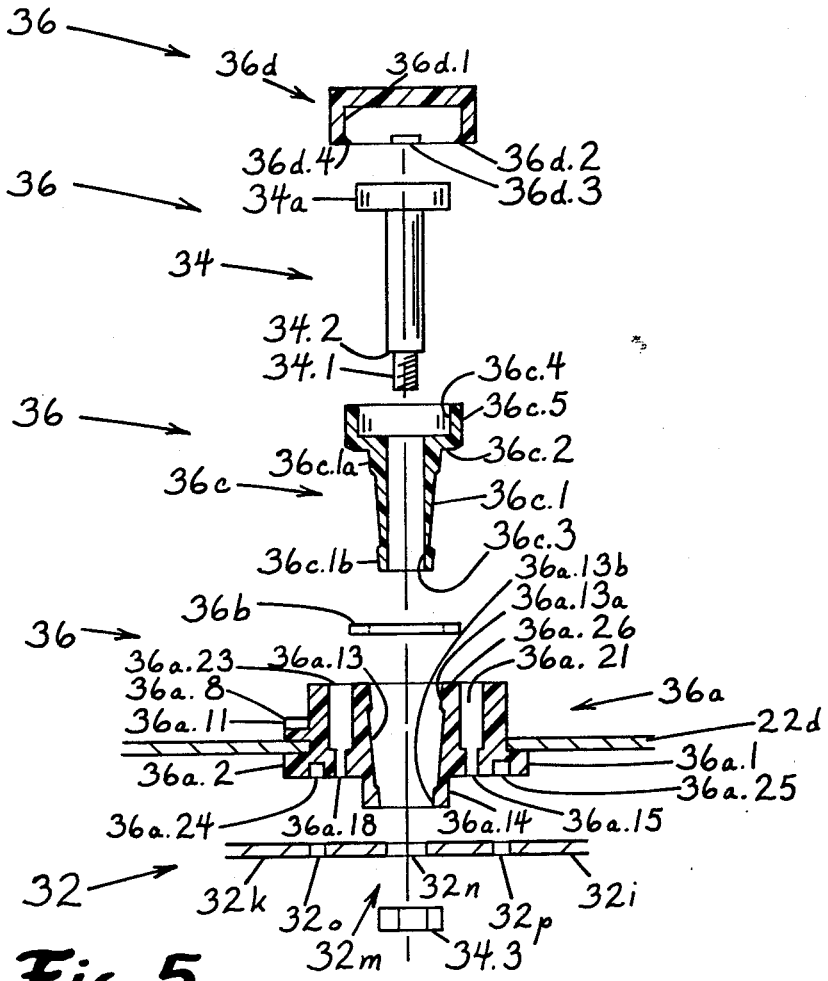
FIG. 5 illustrates an exploded vertical sectional view of the components of an antenna rotating assembly 36.
Figure 7:
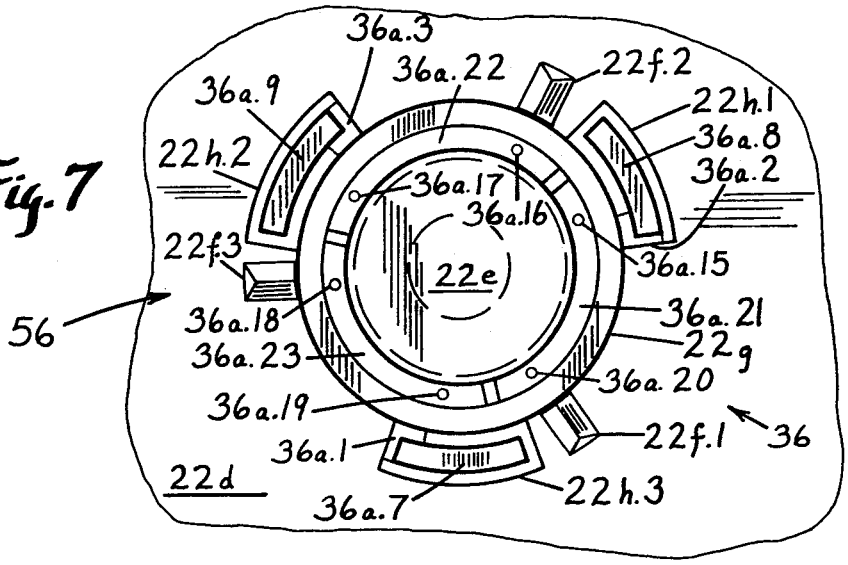
FIG. 7 illustrates a top view of an antenna assembly prior to locking engagement in a dome wall.
Figure 8:
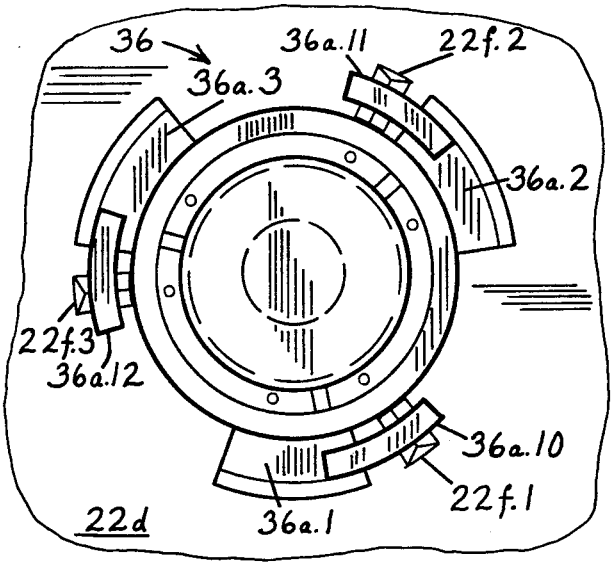
FIG. 8 illustrates a top view of an antenna assembly locked in engagement in a dome wall.
Figure 9:
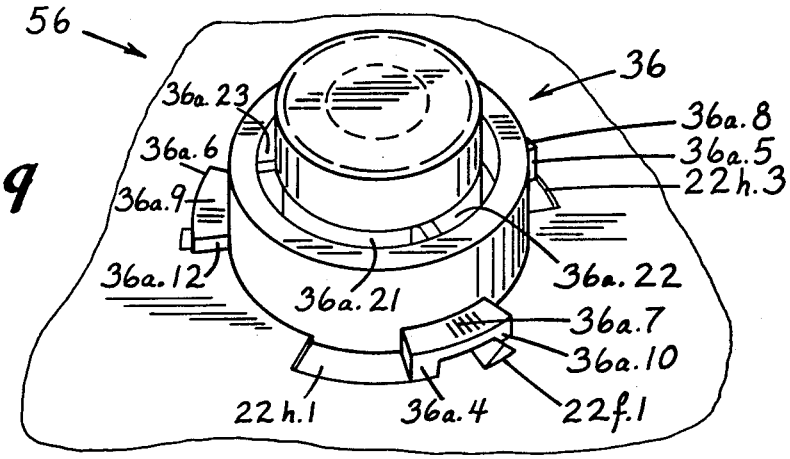
FIG. 9 illustrates a top perspective view of the antenna assembly locked in engagement with the dome wall.

FIG. 5, which illustrates an exploded vertical sectional view of the components of the antenna rotating assembly 36 and also referencing FIGS. 6–9 shows the antenna rotating assembly 36 including in order, a dielectric bushing 36a, a dielectric washer 36b, a dielectric bearing 36c, and a dielectric antenna cap 36d where each component of the assembly 36 is now described in explicit detail. The bushing 36a of dielectric material such as plastic includes a plurality of horizontal outward extending ring or lip sections 36a.1–36a.3, vertical upward extending members 36a.4–36a.6 connected to the respective rings 36a.1–36a.3, horizontal extending members 36a.7–36a.9 and downward extending keys 36a.10–36a.12 connected to the respective elements as also illustrated in the other figures. A plurality of keyway sections 22h.1–22h.3 are circumferentially positioned in an aperture 22g of the top wall 22d of the dome 22, and provide for clearance of the respective elements 36a.4–36a.12 of antenna rotating assembly 36. An internal diameter of partially decreasing taper 36a.13 geometrically coincides with the external taper 36c.1 of the bearing 36c as later described. The internal diameter 36a.13 includes an upper and lower vertical contact surface sections 36a.13a and 36a.13b respectively of finite height and no draft. A downwardly extending member 36a.14 provides additional length of the external taper 36c.1 of the axial bearing 36c and supports the lower vertical contact surface section 36a.13b. A plurality of moisture drain holes 36a.15–36a.20 extend entirely through the base of the bushing 36a and provide for drainage in cores 36a.21–36a.23 of the bushing 36a as illustrated in FIG. 9. Two antenna assembly installation holes 36a.24 and 36a.25, which hold the directional rotational antenna 32 and the bushing 36 in alignment during installation, extend partially upwards into the base of the bushing 36a as illustrated. The dielectric washer 36b such as low friction Teflon having inner and outer diameters equal to inner and outer diameters of horizontal surface 36a.26 and bearing 36c coincides therewith at horizontal surface 36c.2. The bearing 36c includes internal diameters 36c.3 and 36c.4 which accept the outer diameters of the probe antenna 34 including the capacitive top hat 34a. The external taper 36c.1 includes an upper and lower vertical contact surface sections 36c.1a and 36c.1b respectively of finite height and no draft. The vertical contact surfaces 36a.13a and 36c.1a, and 36a.13b and 36c.1b contact each other respectively during axial rotation of the bearing 36c in the bushing 36a. The tapers 36a.13 and 36c.1 geometrically coincide but do not contact each other during axial rotation. The antenna cap 36d having an internal diameter 36d.1 accepts an external diameter 36c.5 of the bearing 36c. A plurality of lock tabs 36d.2–36d.5 extend outwardly from the internal diameter 36d.1 of the antenna cap 36d to engage against the external diameter 36c.5 of the bearing 36c. A hole 32n at the junction 32m of the directional rotating antenna accepts the threaded portion 34.1 of the probe antenna 34 and abuts up against the bottom lip 34.2 of the probe antenna 34 so as to be tightly secured to the bottom lip 34.2 by the nut 34.3 of the probe antenna 34. Holes 32o and 32p in the transmission line conductors 32i and 32k of the directional rotating antenna 32 coincide with the antenna mounting holes 36a.24 and 36a.25 in the bushing 36a for mounting the antenna 32, the bushing 36a and the antenna rotor 38 as later discussed into the top wall 22d of the dome 22 as later described in detail.

Figure 6:
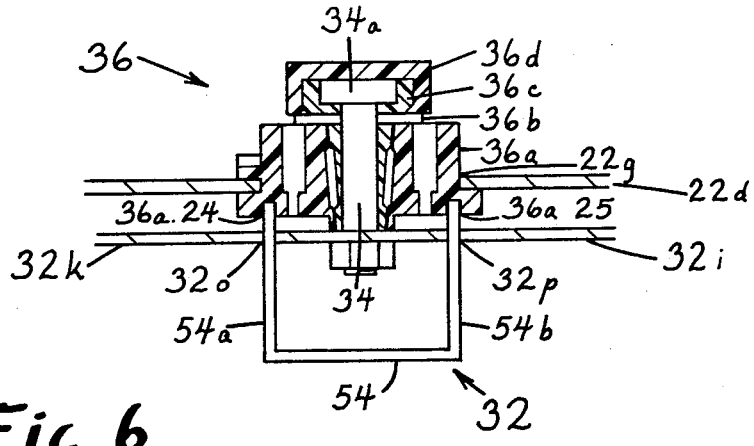
FIG. 6 illustrates a vertical sectional view of the antenna rotating assembly of FIG. 5 assembled.

FIG. 6 illustrates a vertical sectional view of the antenna rotating assembly 36 of FIG. 5 assembled and positioned in the top wall 22d of the dome 22 in the aperture 22g and axially supporting the antenna 32 as illustrated. A mounting member 54 having parallel opposing arms 54a and 54b extends through the antenna mounting holes 32o and 32p of the antenna 32 and into the antenna mounting holes 36a.24 and 36a.25 of the bushing 36a. An antenna rotor 38 not illustrated has an inner hole 38l as illustrated in FIG. 12 to provide clearance for the arms 54a and 54b. All numerals correspond to the elements delineated in FIG. 5.

FIG. 7 illustrates the antenna assembly 56 prior to locking into engagement with the upwardly extending teeth 22f.1–22f.3 of the dome wall 22d. The antenna assembly 56 including the antenna rotating assembly 36, the antenna 32 not illustrated, and the antenna rotor 38 not illustrated, are pushed up through the aperture 22g at the center 22e of the top wall 22d of the dome 22 from within the interior confines of the microwave oven cavity 14 to the position where the rings 36a.1–36a.3 of the antenna rotating assembly 36 coincide and abut up against the bottom of the top wall 22d of the dome 22. Subsequently, the antenna assembly 56 is rotated in a counterclockwise direction as viewed from the top into the engaged and locked position illustrated in FIG. 8.

FIG. 8 illustrates a top view of the antenna assembly 56 where the keys 36a.10–36a.12 are locked into engagement with the upwardly extending teeth 22f.1–22f.3 respectively of the dome 22. The bearing 36c not illustrated axially rotates in the bushing 36a when the velocity of air flow strikes the turbine vanes 38a–38f of FIG. 12 of the antenna rotor 38 supported on the directional rotating antenna 32.

FIG. 9 illustrates a top perspective view of the antenna assembly 56 locked into engagement in the top wall 22d of the dome 22. All numerals correspond to those elements previously delineated.

Figure 10:
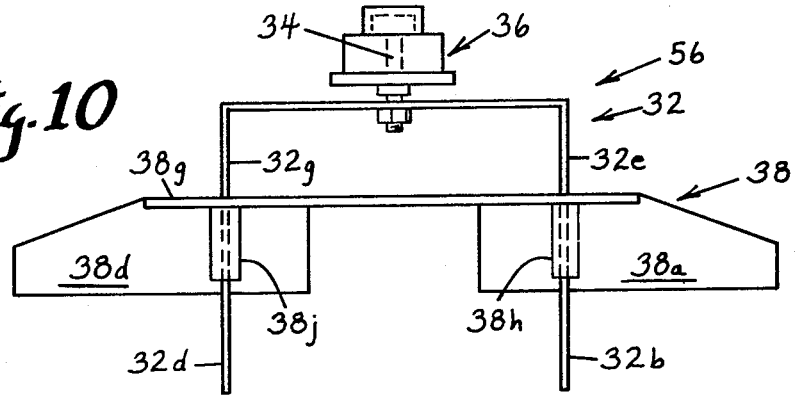
FIG. 10 illustrates a side view of the antenna assembly prior to bending resonating elements of a directional rotating antenna in an antenna rotor.
Figure 11:
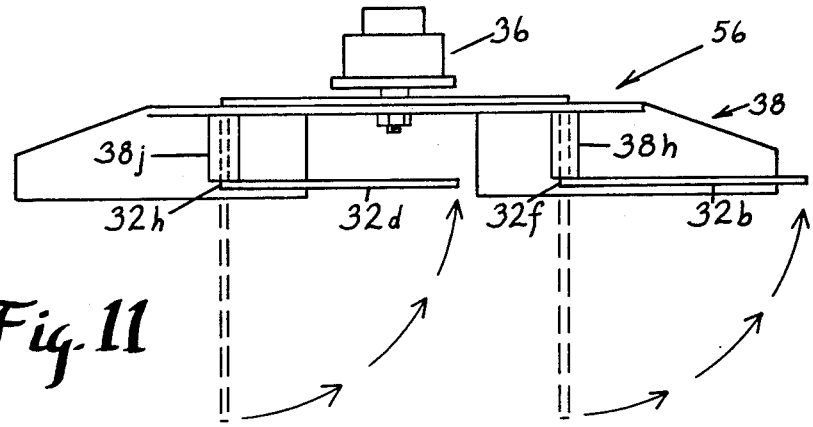
FIG. 11 illustrates a side view of the antenna assembly.

FIG. 10, and also referring to FIGS. 11 and 12, illustrates a side view of the antenna assembly 56 including the antenna 32 prior to bending the resonating elements 32a–32d, the antenna rotating assembly 36 as previously described in detail in FIGS. 5–9, and the antenna rotor 38 as now described in detail. The antenna rotor 38 includes a plurality of outwardly extending turbine vane blades 38a–38f affixed in an equal angular displacement around the center of the disc 38g as illustrated in FIG. 12. Four longitudinal downwardly extending slotted rectangular keyways 38h–38k extend perpendicular to the disc 38g and receive the respective vertical supports 32e–32h of the directional rotating antenna 32. The resonating elements 32a–32d of the antenna are pushed through the rectangular slotted keyways 38h–38k of the antenna rotor 38 as illustrated in FIG. 10 to the position where the slots surround the vertical supports 32e–32h and the parallel plate transmission line conductors 32e–32h engage against the top of disc 38g of the antenna rotor 38.

FIG. 11 illustrates a side view of the antenna assembly 56 including the directional rotating antenna 32 supporting the antenna rotor 38 and axially supported by the antenna rotating assembly 36. The antenna rotor 38 affixes to the directional rotating antenna 32 by opposing right angle bends in the vertical supports 32e–32h between the parallel plate transmission line conductors 32i–32l and the resonating elements 32a–32d thereby locking the directional rotating antenna 32 to the antenna rotor 38.

FIG. 12 illustrates a bottom view of the antenna assembly 56 including the directional rotating antenna 32 supporting the antenna rotor 38 and axially supported in the antenna rotating assembly 36 as previously described.

Figure 13:
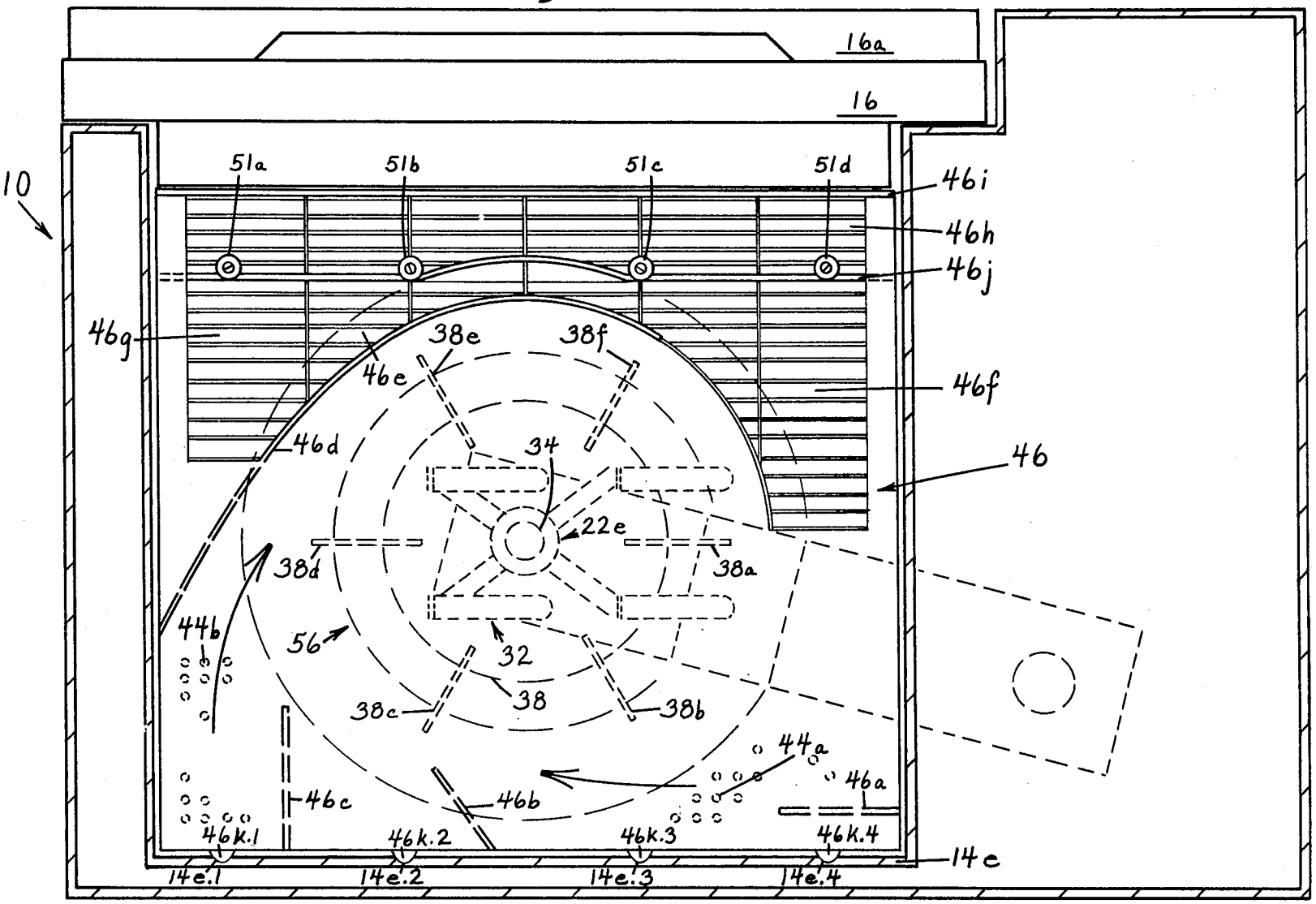
FIG. 13 illustrates a section of the present invention taken on line 13—13 of FIG. 4 looking in the direction of the arrows and illustrates a view looking upwardly towards a grease shield.

FIG. 13, which illustrates a section of the present invention taken on line 13—13 of FIG. 4 looking in the direction of the arrows, shows the grease shield 46, which includes the upwardly extending vertical directional vanes 46a–46d illustrated in dashed lines extending upwardly on the grease shield to force the velocity of the air flow from the vent holes 44a and 44b in a clockwise direction to drive the turbine vane blades 38a–38f of the antenna rotor 38 about the center axis 22e of the dome 22 thereby rotating the directional rotating antenna 32 about the center axis of the dome 22. Upwardly extending vertical members 46d provides that the air flow velocity continues in a circular pattern towards the antenna assembly 56. The plurality of louvers 46e–46g in the grease shield 46 exhaust air into the cavity. A vertical member 46j extends upwardly between the grease shield and the top wall 14a of the microwave oven cavity 14 and is connected to the top wall 14a by screws 51a–51d. Longitudinal louvers 46h exhaust air from the microwave oven cavity between the grease shield 46 and the top wall 14*e*, and around past the front wall 14*a*.2 through the holes 52 in the vertical member as shown in FIG. 2. The front vertical extending member 46*i* extends upwardly from the grease shield 46. A plurality of teats 46*k*.1–46*k*.4 extend outwardly from the rear of the grease shield 46 and protrude into respective holes 14*e*.1–14*e*.4 in the rear wall 14*e* of the microwave oven 10 to securely engage the rear of the grease shield 46 into rear wall 14*e*.

Figure 14:
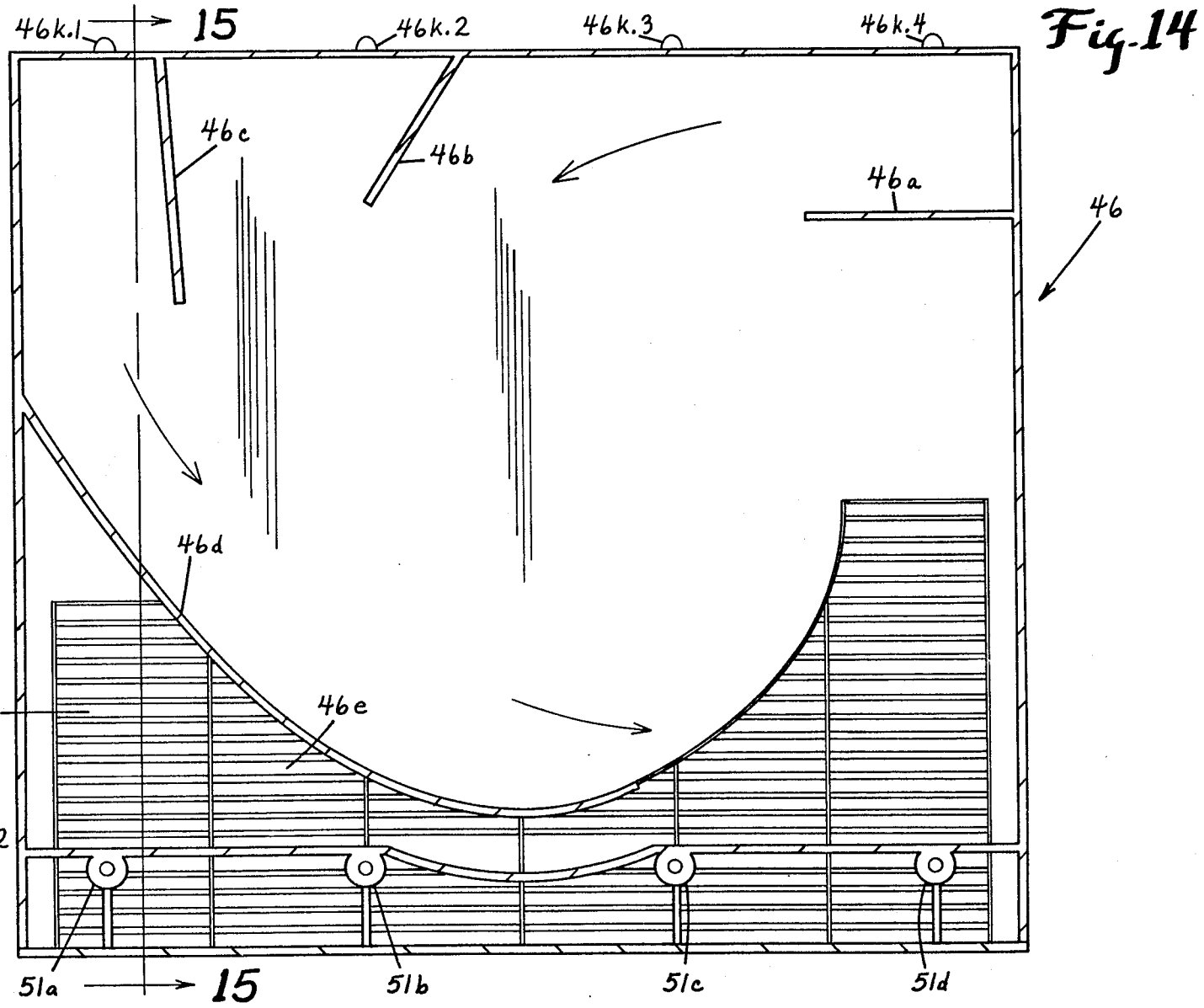
FIG. 14 illustrates a section of the grease shield taken along the lines 14—14 of FIG. 4 and illustrates a top view looking downwardly towards the grease shield.

FIG. 14 illustrates a section of the grease shield 46 taken along the lines 14—14 of FIG. 4 which illustrates a top view looking down on the grease shield in position in the microwave oven cavity 14. All numerals correspond to those numerals previously delineated.

Figure 15:
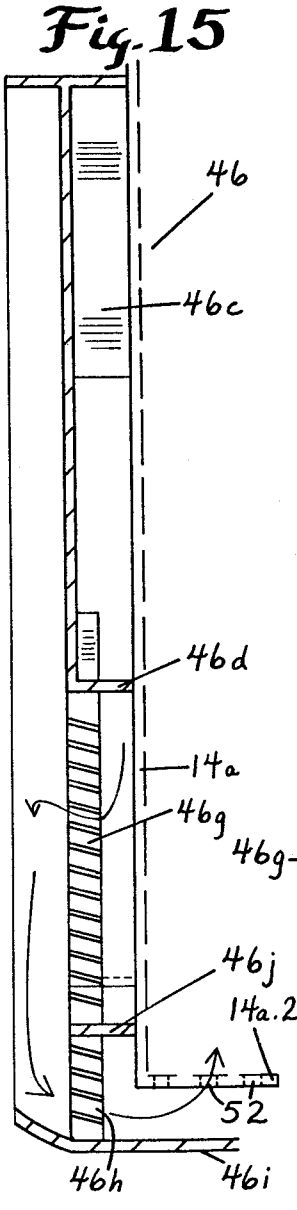
FIG. 15 illustrates a section of the grease shield looking in the direction of the arrows 15—15 of FIG. 14 and illustrates a cutaway view of the grease shield; and, FIG. 16 illustrates a vertical sectional view of another embodiment of the present invention.

FIG. 15 which illustrates a section looking in the direction of the arrows 15—15 of FIG. 14 shows a side cutaway view of the grease shield 46 and more particularly, shows the directional vanes 46*e* and 46*d*, the louvers 46*g*, the vertical member 46*j*, the louvers 46*h*, and the vertical member 46*i* of the front of the grease shield 46.

Figure 16:
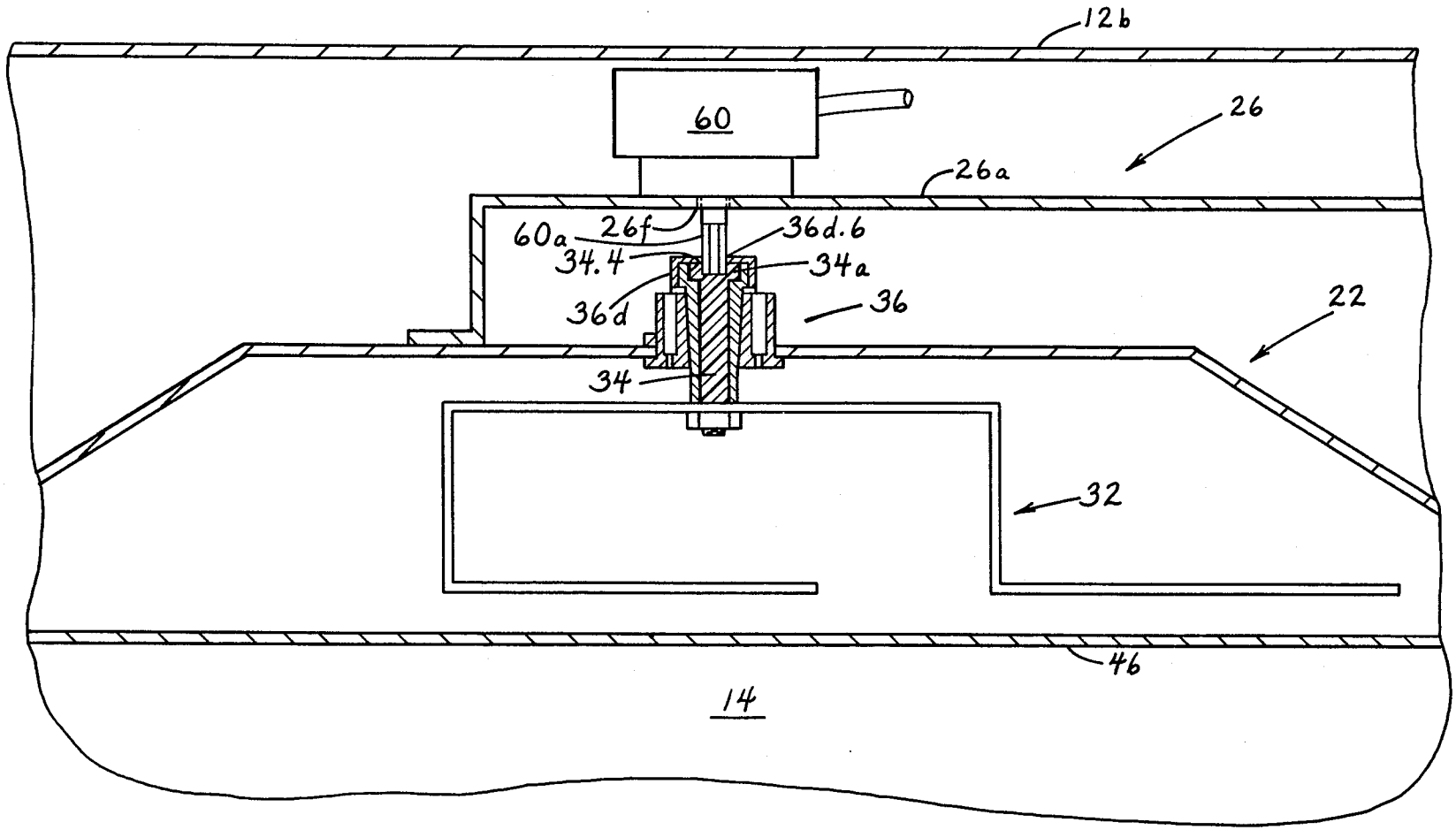

FIG. 16, which illustrates a vertical sectional view of another embodiment of the present invention, shows the top housing wall 12*b*, the microwave oven cavity 14, the dome 22, the waveguide 26, the directional rotating antenna 32, and the antenna rotating assembly 36. Specifically, a hexagonal hole 34.4 extends partially into the top center of the capacitive top hat 34*a* of the probe antenna 34. A hexagonal hole 36*d*.6 in the antenna cap 36*d* coincides with the hexagonal hole 34.4 in the probe antenna 34. A motor 60 affixes to the top wall 26*a* of the waveguide 26 and a dielectric hexagonal shaft 60*a* extends down through an aperture 26*f* in the waveguide 26, through the hexagonal hole 36*d*.6 in the antenna cap 36*d*, and into the hexagonal hole 34.4 of the probe antenna 34. All other elements correspond to those elements previously described.

PREFERRED MODE OF OPERATION

FIGS. 10–12 illustrate the antenna assembly 56. The directional rotating antenna 32, in a first bending operation, is formed at a first perpendicular bend having a finite radius at the junction of the supports 32*e*–32*h* and the microstrip parallel plate transmission line conductors 32*i*–32*l* as illustrated in FIG. 10. The resonating elements 32*a*–32*d* integrated and attached to the vertical supports 32*e*–32*h* are pushed down through the keyway slots 38*h*–38*k* respectively in the antenna rotor 38. Subsequently, a wiping die in a second bending operation bends the resonating elements 32*a*–32*d* of the antenna upwardly ninety degrees as illustrated in FIG. 11 forming an opposing second perpendicular bend having a finite radius where the resonating elements 32*a*–32*d* are in a plane parallel to the microstrip parallel plate transmission line conductors 32*i*–32*l*. The vertical supports 32*e*–32*h* are engaged and locked in position in the slots of the keyways 38*h*–38*k* of the antenna rotor 38 between the opposing first and second perpendicular bends. The vertical supports 32*e*–32*h* longitudinally lie in the slots 38*h*–38*k*, and opposing perpendicular bends reside at the top and bottom of the slots 38*h*–38*k*. The microstrip parallel plate transmission line conductors 32*i*–32*l* reside adjacent the top of the disc 38*g* of the antenna rotor 38.

FIGS. 5 and 6 illustrate the probe antenna 34 accepted in the axial bearing 36*c*, the axial bearing 36*c* axially supported on the bushing 36*a* with the washer 36*b* in between the components 36*a* and 36*c*, and the antenna 32 affixed to the probe antenna 34 with the nut 34.3. The antenna cap 36*d* frictionally engages over the outer diameter of the axial bearing 36*c* with the lock tabs 36*d*.2–36*d*.5 to provide a dielectric insulation between the probe antenna 34 and the waveguide 26.

FIGS. 6–9 illustrate mounting of the antenna assembly 56 in the top wall 22*d* of the dome 22 in the microwave oven cavity 14. FIG. 7 illustrates pushing the antenna assembly 56 up through the aperture 22*g* in the top wall 22*d* of the dome 22 in the microwave oven cavity 14*a*. FIG. 8 illustrates turning the antenna assembly 56 in a counterclockwise position to lock the keys 36*a*.10–36*a*.12 in position over the teeth 22*f*.1–22*f*.3 in the top wall 22*d* of the dome 22 in the microwave oven cavity 14. FIG. 9 illustrates a perspective view of the keys 36*a*.10–36*a*.12 locked over and engaged with the teeth 22*f*.1–22*f*.3. The rotational motion of FIGS. 7–9 is accomplished by inserting the member 54*a* and 54*b* of the tool 54 through the holes 32*o* and 32*p* in the parallel plate transmission line conductors 32*i* and 32*k* of the antenna 32, and up into the holes 36*a*.24 and 36*a*.25 in the bushing 36*a*. This provides simultaneous engagement of the bushing 36 and the antenna 32 having the antenna rotor supported on the antenna 32 to permit installation of the antenna assembly 56 in the top wall 22*d* of the dome 22 in the microwave oven of FIGS. 7–9 by a qualified serviceman having the proper tool 54 and knowledge of servicing techniques. Removal of the antenna assembly 32 is accomplished in the reverse manner of FIGS. 9–7 respectively.

FIG. 4 illustrates the directional rotating antenna 32 rotating about the vertical axis of the dome 22 of the top wall of the microwave oven cavity 14. The grease shield 46 of the figures directs the air in a clockwise rotational flow to rotate the antenna 32 about the center axis of the microwave oven cavity 14 uniformly distributing microwave energy within the confines of the conductive microwave oven cavity 14.

The air flow velocity path through the microwave oven 10 is best illustrated by referencing FIGS. 3, 13–15 and 2 in the respective order.

FIG. 3 illustrates the blower 40 which brings air in through a plurality of holes not illustrated in the bottom housing base of the microwave oven 10, up past the right side of the oven housing 12*c*, past the rectifier, past the transformer, past control circuitry for the power supply, up through the blower 40, through the heat dissipating plates of the microwave power source 28, up through the rear vent holes 42*a* and 42*b*, through the rear of the oven along the longitudinally extending member 48, and subsequently down into the microwave oven cavity 14 through the vent holes 42*a* and 42*b* between the top wall 14*a* of the microwave oven cavity 14 and the grease shield 46. The directional vanes 46*a*, 46*b*, and 46*c* of FIG. 13 direct the air flow in a clockwise rotational manner about the antenna rotor 38 thereby rotating the antenna 32 and the probe antenna 34 axially on the bushing 36*a*. The flow of air as shown in FIGS. 13, 14 and 15 then travels down through the louvers 46*e*–46*g* in the grease shield 46 which produces a path of travel across the door 16. Air also flows out through the holes 52. The air in the microwave oven cavity 14 travels across the door 16, up through the longitudinal louvers 46*h*, in between the edge of the grease shield 46*i* and the upwardly extending perforated exhaust panel 14*a*.2, and out through the plurality of holes 52 to be exhausted out through the front exhaust vent 20 illustrated in FIG. 2. Significantly, the moisture and vapor in the air does not travel past any moving components in the top of the microwave oven and is exhausted out through sheet metal ducting between the top of the housing 12*b* and the top wall 14*a* of the microwave oven. The air travel path provides a clean smooth air flow path having least resistance permitting a minimal size of blower motor.

The directional rotating antenna 32 axially can rotate in the range of 25–250 revolutions per minute and preferably in the range of 40–90 revolutions per minute. The air flow velocity and volume of air is predetermined and a function of the blower motor 40 to obtain the predetermined revolutions per minute. Any back pressure of air between the microwave oven cavity 14 and the grease shield 46 is vented through the holes 50 in the top wall 14*a*.

FIG. 16 illustrates another embodiment of rotating the directional rotating antenna 32 with the motor 60 in lieu of utilizing air flow velocity through the grease shield 46 as illustrated in FIG. 14.

Various modifications can be made to the microwave oven 10 of the present invention without departing from the apparent scope thereof. The antenna rotating assembly 36 can be utilized in any microwave oven and can axially support any directional rotating antenna 32. The antenna rotor 38 can accept any directional rotating antenna with suitable and corresponding geometrical and angular positioning of the plurality keyway slots.

Having thus described the invention, what is claimed is:

1. Antenna assembly for a microwave oven having a flow of air circulating through a microwave oven cavity comprising:

a. directional rotating antenna means;

b. probe antenna means connected to a common junction of said directional rotating antenna means; and, c. antenna rotating means including a dielectric bearing axially supporting said probe antenna means and a dielectric bushing rotatably supporting said bearing, said bushing including means for locking said antenna rotating means into engagement is a wall of said microwave oven cavity, said locking means including a plurality of outwardly extending key means and said wall including an equal plurality of keyway means, each of said keyway means including a tooth whereby said probe antenna means excites said directional rotating antenna means with microwave currents providing uniform energy distribution and consistent heating within said microwave oven cavity and said key means inserts through said keyway means and each of said key means engages with each of said tooth of said keyway means.

2. The antenna assembly of claim 1 comprising antenna rotor means including a plurality of circumferentially spaced outwardly spaced extending radial turbine vanes supported on said directional rotating antenna means whereby said turbine vanes of said antenna rotor means are driven by said air flow through said cavity thereby rotating said antenna rotor in an axial direction and likewise rotating said directional rotating antenna in a likewise axial direction in said antenna rotating means.

3. Microwave energy distribution system in a microwave heating cavity for uniformly distributing the microwave energy in said microwave heating cavity comprising:

a. directional rotating antenna means including a probe antenna, at least one transmission line conductor connected to said probe antenna, at least one vertical support connected to said transmission line conductor, and at least one antenna element connected to said vertical support;

b. antenna rotor means including a flat circular dielectric disc having a diameter less than the dimension of said microwave heating cavity and including a plurality of outward radially extending turbine vanes perpendicular to said circular disc and at least one downwardly extending member including a keyway slot, said vertical support accepted within said keyway slot, said transmission line conductor adjacent the top of said disc, and said element extending parallel to said disc, and;

c. rotation means axially supporting said probe antenna and including a plurality of mounting rings with upwardly extending locking means whereby said locking means engage with teeth on an exterior surface of a wall of said microwave heating cavity and said mounting rings engage against an interior surface of said wall of said microwave oven heating cavity.

4. Microwave energy distribution system of claim 3 wherein said directional rotating antenna means comprises a two element array.

5. Microwave energy distribution system of claim 3 wherein said directional rotating antenna means comprises a two element planar array.

6. Microwave energy distribution system of claim 3 wherein said directional rotating antenna means comprises a two-by-two planar array.

7. Microwave energy distribution system of claim 3 wherein said antenna rotor means has six angularly distributed turbine vanes about the center.

8. Microwave energy distribution system of claim 3 wherein said rotation means comprises a stationary cylindrical bushing means including said plurality of mounting rings with said upwardly extending locking means and a bearing means axially disposed in said bushing means.

9. Microwave energy distribution system of claim 8 comprising washer means horizontally disposed between said bushing means and said bearing means.

10. Microwave energy distribution system of claim 8 wherein each of said locking means comprises a vertical member affixed to each of said outwardly extending rings, a horizontal member affixed to each of said vertical members and extending parallel to said ring surface, and a downwardly extending key affixed to the end of each of said horizontal member, and said wall is provided with a plurality of respective keyways spaced about an aperture in said wall and a plurality of upwardly extending teeth whereby said rotation means is inserted upwardly through said aperture from within the interior confines of said cavity, said locking means extends upwardly through said keyways, and rotates into locking engagement with said teeth thereby locking said keys of said rotation means into engagement with said teeth about said aperture.

11. Microwave energy distribution system of claim 8 comprising opposing mounting holes extending partially into the bottom of said cylindrical bushing means whereby said holes provide for insertion of means extending into said opposing mounting holes to move said rotation means into engagement or disengagement with said wall.

12. Microwave energy distribution system of claim 11 comprising tool means including opposing parallel members to engage into said opposing mounting holes.

13. Microwave energy distribution system of claim 8 comprising a plurality of moisture drain holes extending through said cylindrical bushing means whereby any moisture or condensation drips through said drain holes into said cavity.

14. Microwave energy distribution system of claim 8 comprising bearing means including a tapered outer diameter having an upper and lower contact surface to coincide with upper and lower contact surfaces of a housing, an inner diameter to accept said probe antenna, and horizontal flange surface whereby said horizontal flange surface rotates on the top surface of said bushing means and said bushing means axially supports said bearing means.

15. Microwave energy distribution system of claim 14 comprising washer means disposed between said horizontal flange surface and said top surface of said bushing.

16. Microwave energy distribution system of claim 11 comprising antenna cap means having an inner diameter slightly larger than the outer diameter of said bearing means whereby said antenna cap means dielectrically encloses said probe antenna in said bearing means.

17. Microwave energy distribution system of claim 16 comprising a plurality of lock tabs circumferentially spaced around the inner diameter of said antenna cap whereby said tabs engage against the outer diameter of said bearing means.

18. In combination, an antenna assembly comprising:

a. directional rotating antenna means including a probe antenna;

b. antenna rotating means axially supporting said probe antenna means and including means for locking said antenna rotating means into one wall of a microwave oven cavity; and, c. antenna rotor means including a plurality of radial outward extending turbine vanes, said antenna rotor means supported on said directional rotating antenna means.

19. The combination of claim 18 comprising motor means connected to said antenna rotating means.

20. Antenna rotating assembly for axially mounting a directional rotating antenna including a vertical probe antenna in one wall of a microwave heating cavity comprising:

a. bushing means including a cylindrical member, plurality of lips extending outwardly from said cylindrical member, vertical member including horizontal member and downward extending key attached to and extending from each of said lip, a tapered inner diameter in said cylindrical member including an upper and lower contact surface, plurality of cores extending the length of said cylindrical member, a plurality of moisture drain holes extending through said cavity, and at least two mounting holes extending partially upward into said cylindrical member;

b. washer means including an inner diameter to coincide with said tapered inner diameter and disposed on a top surface of said cylindrical member;

c. bearing means including a tapered outer diameter including an upper and lower contact surface to coincide and axially rotate within said tapered inner diameter of said bushing means, an outwardly extending flange to axially rotate on said washer and at least one inner diameter to receive a probe antenna including a capacitive top hat affixed to a common junction of said directional rotating antenna, and;

d. antenna cap means having an inner diameter to receive the outer diameter of said flange of said bearing means whereby said antenna cap means encloses and dielectrically isolates said probe antenna from the waveguide, said bushing means engages and disengages in locking engagement with said wall, and said bearing means provides for axial rotation of said directional rotating antenna thereby providing uniform energy distribution and consistent heating within said microwave heating cavity.

21. Antenna rotor for a directional rotating antenna axially mounted about an axis in a microwave heating cavity comprising:

a. disc means including a first inner diameter and a second outer diameter;

b. plurality of longitudinal radial outwardly extending turbine vane means from between said first and second diameters to a point beyond said second diameter and perpendicular to said disc means, and;

c. plurality of perpendicular channel members extending downwardly from said disc and including a keyway slot in each of said members whereby said each of said slots accepts supports of said directional rotating antenna and said turbine vanes provide for transmitting force from air flow velocity moving through and within said microwave heating cavity thereby rotating said directional rotating antenna.

22. The antenna rotor of claim 21 comprising at least two channel members whereby said members accept supports of a two element directional rotating antenna.

23. The antenna rotor of claim 21 comprising at least four channel members whereby said members accept supports of a two-by-two directional rotating antenna.

24. Antenna rotor for a directional rotating antenna including at least one transmission line conductor, support and resonating element axially mounted about an axis in a microwave oven heating cavity comprising:

a. disc means including a first inner diameter and a second outer diameter, and;

b. plurality of channel members extending downwardly from said disc and including a keyway slot in each of said members whereby each of said slots accepts said support of said directional rotating antenna, and said transmission line conductor and said element lock into engagement with said channel members.

* * * * *